US009887443B2

(12) United States Patent
Arnold et al.

(10) Patent No.: US 9,887,443 B2
(45) Date of Patent: Feb. 6, 2018

(54) GENERIC CHANNEL FILTER

(71) Applicant: Tesat-Spacecom GmbH & Co. KG, Backnang (DE)

(72) Inventors: Christian Arnold, Backnang (DE); Jean Parlebas, Burgstetten (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 177 days.

(21) Appl. No.: 14/836,134

(22) Filed: Aug. 26, 2015

(65) Prior Publication Data

US 2016/0064790 A1 Mar. 3, 2016

(30) Foreign Application Priority Data

Aug. 27, 2014 (DE) ..... 10 2014 012 752

(51) Int. Cl.

| | |
|---|---|
| ***H01P 1/208*** | (2006.01) |
| ***H01P 7/06*** | (2006.01) |
| ***H01P 5/08*** | (2006.01) |
| ***H01P 5/04*** | (2006.01) |

(52) U.S. Cl.

CPC ..... *H01P 1/208* (2013.01); *H01P 5/04* (2013.01); *H01P 5/08* (2013.01); *H01P 7/06* (2013.01)

(58) Field of Classification Search

CPC ..... H01P 1/207; H01P 1/264; H01P 5/022; H01P 1/208; H01P 5/04; H01P 5/08

USPC ..... 333/202–212, 239, 248, 227, 231

See application file for complete search history.

(56) References Cited

U.S. PATENT DOCUMENTS

| | | | | |
|---|---|---|---|---|
| 5,764,115 | A * | 6/1998 | Hattori | H01P 1/2086 333/202 |
| 7,965,706 | B2 | 6/2011 | Iwakawa et al. | |
| 2004/0051603 | A1 | 3/2004 | Pance et al. | |
| 2013/0009728 | A1 | 1/2013 | Puoskari et al. | |
| 2013/0093539 | A1 | 4/2013 | Hedemaki et al. | |

FOREIGN PATENT DOCUMENTS

| | | |
|---|---|---|
| DE | 2 108 675 A1 | 9/1971 |
| GB | 1 297224 | 11/1972 |

OTHER PUBLICATIONS

European Search Report issued in European counterpart application No. EP 15 00 2377 dated Jan. 21, 2016, with Statement of Relevancy (Three (3) pages).

* cited by examiner

*Primary Examiner* — Rakesh Patel
(74) *Attorney, Agent, or Firm* — Crowell & Moring LLP

(57) ABSTRACT

Provided is a channel filter for a communication apparatus. The channel filter includes a first resonator, a coupling element having a first longitudinal section and a second longitudinal section, and a first adjusting element. The coupling element is designed to couple the first resonator at least indirectly with an input or output of the channel filter. The first longitudinal section has a greater width than the second longitudinal section. The first adjusting element is disposed at least partially in the first longitudinal section and at least partially in the second longitudinal section.

17 Claims, 4 Drawing Sheets

GENERIC CHANNEL FILTER

CROSS REFERENCE TO RELATED APPLICATION

This application claims priority under 35 U.S.C. § 119 from German Patent Application No. 10 2014 012 752.4, filed Aug. 27, 2014, the entire disclosure of which is herein expressly incorporated by reference.

FIELD OF THE INVENTION

The present invention relates to a channel filter for a communication apparatus or for a data transmission link, in particular for a satellite transmission link, in particular for a satellite radio transmission link. The satellite radio transmission link may be, for example, a Ka band transmission link in a frequency range from 17.7-21.2 GHz for the downlink and 27.5-31 GHz for the uplink, or may be a Ku or X band implementation in a range of 11 or 7 GHz.

BACKGROUND OF THE INVENTION

Resonators in the form of a passive component can be used as a channel filter in radio transmission links. Channel filters used in practice usually consist of a plurality of coupled resonators. With increasing frequency of the signal transmission on a radio link, the requirements on the filter change, in particular the structural and spatial requirements on the one hand as well as the demands on the usable bandwidth of a filter. The usable bandwidth here is that frequency bandwidth at which a filter response around a central frequency is constant or nearly constant.

Depending on the resonant frequency of a filter, it is usually necessary to adjust, for example, the geometrical dimensions of a filter.

Channel filters may be used, for example, in so-called output multiplexers. A typical output multiplexer comprises channel filters, which are connected to a waveguide busbar. One object of the output multiplexer is to combine narrowband high power communication signals on a common waveguide (the so-called busbar). The channel filters and busbar are coordinated in a complex development process. The individual parts for the channel filters as well as the busbar and any necessary additional parts can usually only be ordered and manufactured after the end of this development process.

In the currently commonly used Invar circular waveguide technology, as well as all other available technologies, various complex construction and development processes are to be observed, as these devices may comprise many customized individual parts. The individual parts must usually be individually manufactured and procured for each channel filter. By means of the adjusting screws which are provided in this technology, a fine adjustment of the resonant frequency in the range of a few parts per thousand of the resonant frequency can occur. However, a free setting of the filter frequency (resonant frequency) is not possible.

With the TE01n mode, which is frequently used for the temperature compensation of aluminum filters, it is possible in contrast to displace a complete end wall of the resonator, as these modes do not require wall currents from side walls to the end wall. This structure is usually used for the compensation of temperature influences.

SUMMARY OF THE INVENTION

It can be regarded as an object of the invention to provide a channel filter, the resonant frequency of which is adjustable in a wide frequency band.

This object is achieved by the subject of the independent claim. Further exemplary embodiments of the invention arise from the dependent claims as well as the following description.

According to a first aspect of the invention, a channel filter for a communication apparatus is provided. The channel filter comprises a first resonator, a coupling element having a first longitudinal section and a second longitudinal section, and a first adjusting element. The coupling element is designed to couple the first resonator at least indirectly with an input or output of the channel filter, wherein the first longitudinal section has a greater width than the second longitudinal section, and wherein the first adjusting element is disposed at least partially in the first longitudinal section and at least partially in the second longitudinal section.

The amount of energy coupled by means of the coupling element is relevant in particular for filter characteristics such as bandwidth and alignment. Therefore, it may be beneficial if this can be set over the widest possible frequency range.

The first adjusting element is used for adjusting the coupling element. This may substantially replace in one embodiment an upper part of the coupling element and can thus represent in particular a variably configurable coupling element. The upper part of the coupling element can either be replaced entirely by the adjusting element or be partially present or present in a reduced form. In one embodiment, the adjusting element can be designed as a metallic or dielectric screw, wherein the metallic screw reduces the amount of coupled energy and the dielectric screw increases this.

The first adjusting element extends in a longitudinal direction of the coupling element at least partially in the first longitudinal section and the second longitudinal section. In other words, the first adjusting element is disposed at the transition between the first longitudinal section and the second longitudinal section.

The first adjusting element enables a movement transverse to the longitudinal direction of the channel filter, i.e. toward and away from the center point of the coupling element.

According to one embodiment of the invention, the first longitudinal section is a coupling iris.

The coupling iris is designed to couple the first resonator to an adjacent or immediately adjacent resonator. An adjusting movement of the first adjusting element extends transversely to the coupling direction of the coupling iris between the first resonator and the adjacent resonator, wherein the coupling direction usually runs in the direction of the longitudinal direction of the channel filter.

According to a further embodiment of the invention, the second longitudinal section is a waveguide.

The cross section of the waveguide is larger than the cross section of the coupling iris. As a measure may also be used the size of the coupling iris as well as the waveguide in a direction orthogonal to the longitudinal direction of the channel filter. The size of the waveguide is greater than the size of the coupling iris.

According to a further embodiment of the invention, the first adjusting element is designed and disposed such that it protrudes in a direction transverse to a longitudinal direction of the coupling element over a side surface of the first longitudinal section.

This may mean that the geometric dimensions of the first adjusting element, such as the diameter or at least one edge length, are greater than the width of the first longitudinal section. The first adjusting element may be disposed such that it protrudes over a single or over two side surfaces, in particular over two opposite side surfaces of the first longitudinal section.

The first adjusting element may be disposed centrally or eccentrically (eccentric) with respect to the first longitudinal section. If the first adjusting element is disposed eccentrically, it may in particular protrude only over a single side surface of the first longitudinal section. In the case of an eccentric disposition of the first adjusting element, this may protrude over a side surface, even if its diameter or its edge length is smaller than the width of the first longitudinal section.

The first adjusting element may be an adjusting screw, which is substantially cylindrically designed. In the case of a central disposition of the adjusting screw with respect to the first longitudinal section, the diameter of the adjusting element is greater than the width of the first longitudinal section.

According to a further embodiment of the invention, the first adjusting element is disposed in a first longitudinal section, such that it extends in a longitudinal direction into the second longitudinal section, between two opposite side surfaces of the second longitudinal section.

In other words, this means that the entire adjusting element is not disposed between two side surfaces of the second longitudinal section, but rather only that part of the adjusting element which is located in the longitudinal direction of the coupling element in the second longitudinal section.

In the case that the first adjusting element is an adjusting screw, the diameter is smaller than the width of the second longitudinal section, and the adjusting screw does not protrude over any side surfaces of the second longitudinal section.

According to a further embodiment of the invention, a coupling angle of the coupling element with the first resonator has a deviation of 0° with respect to the first longitudinal direction of the channel filter.

The coupling with an angle deviating by 0° can also help to ensure that a desired coupling value is reached and can thus contribute to the adjustment of the coupling element and the alignment of the operating frequency of the channel filter.

In particular, the coupling angle between the longitudinal direction of the coupling element and the longitudinal direction of the channel filter may be between 1° and 90°, more preferably between 1° and 45° (respectively in the geometrically positive or negative sense, that is, counterclockwise or clockwise).

According to a further embodiment of the invention, the channel filter has a second resonator, which is coupled with the first resonator via the coupling element.

The channel filter may comprise a plurality of resonators which are respectively coupled to one another via a coupling element.

According to a further embodiment of the invention, a coupling angle of the coupling element with the second resonator deviates with respect to the longitudinal direction of the channel filter from the coupling angle of the coupling element with the first resonator with respect to the longitudinal direction of the channel filter.

In one embodiment, the coupling angle of a coupling element between a first resonator and a second resonator differs from the coupling angles of a coupling element between the second resonator and a third resonator.

According to a further embodiment of the invention, the first resonator has a second adjusting element, which is designed for a coarse adjustment of the resonant frequency of the first resonator.

Coarse adjustment means here that the operating frequency can be changed in a frequency range of up to +/−40%, in particular +/−10% to 20% of its current value.

It can in particularly be made possible by the second adjusting element that a channel filter may be used for different operating frequencies without necessitating a new development of a channel filter.

The second adjusting element is here disposed such that it protrudes into an interior space of the resonator and can be moved in this interior space such that its disposition in the interior space can be altered.

According to a further embodiment of the invention, the first resonator has a third adjusting element, which is designed for a fine adjustment of the resonant frequency of the first resonator.

Through the interaction of the second and third adjusting elements, both a complete change of the operating frequency (coarse adjustment) as well as an alignment, for example to manufacturing tolerances (fine adjustment), may occur.

According to a further embodiment of the invention, the third adjusting element is mechanically coupled to the second adjusting element.

Thus, when the second adjusting element is moved, the third adjusting element is carried along, so that by means of the third adjusting element occurs a fine adjustment based on the coarse adjustment prescribed by the second adjusting element.

According to a further embodiment of the invention, the third adjusting element is movable with respect to the second adjusting element.

In other words, an adjusting movement of the third adjusting element is made relative to the second adjusting element.

According to a further embodiment of the invention, the channel filter has a shorting element, which is disposed to bridge at least the second resonator.

The shorting element may also be designated as a bridging element, which bridges one or more adjacent resonators.

In summary, the channel filter according to one embodiment of the invention can be described as follows.

The channel filter, for example an output multiplexer, can be designed such that the following conditions are met: a generic channel filter is independent of the project-based development and design process; the primary filter parts are identical across projects and can be pre-purchased and kept in stock; faster assembly of the individual parts is possible; an output multiplexer assembled with the use of such a generic channel filter can be set through adjustment of the entire waveguide band.

One aspect of the channel filter is to realize by means of a TE01n implementation a channel filter for an output multiplexer which is as widely adjustable in frequency and bandwidth as possible. The adjustability of the frequency is limited ideally only by the failure-mode-free region of the useful mode, which in the Ka band is approximately 1 GHz. To cover a larger frequency range, however, the geometrical dimensions such as the diameter of the resonators can be easily adjusted. The implementation is independent of the frequency band, a Ka band implementation at 20 GHz/30 GHz is as possible as a Ku or X band implementation in the region of 11, or 7 GHz.

The properties of the resonance mode are used to preset the frequency by means of a coarse adjusting plate. Fine adjustment may take place using a fine adjusting screw integrated in the coarse adjusting plate.

The adjustment of the coupling can occur, for example, by means of iris adjusting screws. These screws can be significantly larger than the actual iris is long or wide. With such iris adjusting screws, the cross section of the iris can be effectively reduced. The overlapping region with the waveguide (i.e. the area in which the screw protrudes over the iris) can be dimensioned such that it is operated at the filter frequency above its so-called cut-off frequency. The cut-off frequency is that frequency above which an electromagnetic wave energy is transported, and below which can be detected only an electromagnetic field.

The resonators may particularly be disposed such that the lateral distance of the filter from the busbar can be kept constant for different operating frequencies and in addition, the total length does not exceed a predetermined length. This is partly due to the fact that the maximum total length of the multiplexer is typically limited by the spatial requirements in the usage environment of the channel filter. An increased distance between the channels may therefore reduce the possible number of channels. On the other hand, the degradation of filter performance can increase with increasing distance of the channels from the bus bar, particularly with respect to temperature.

The resonators are in particular disposed in a row. A desired channel spacing can thereby be realized on the busbar. Electrically, this structure of the channel filter corresponds to a so-called extracted pole structure, that is, a filter with transmission zero points can be realized. A connecting waveguide between the poles can be conducted above or below the two pole resonators. It can either be conducted centrally or slightly laterally offset with respect to a longitudinal axis or central axis of the channel filter, in order to facilitate the accessibility of the adjusting screws and plates.

The coupling irises may either be disposed in a direct line or directed at any desired angle from the resonator, for example for targeted suppression of interference modes. In particular the coupling iris between the first and second resonator of the busbar may be longer than the rest of the coupling irises in one embodiment, so that the couplings can be realized in an arc. As a result, the electrically necessary coupling value may no longer be achieved. To solve this problem, a section of waveguide with a widened cross section may be introduced between the short coupling and decoupling irises. The waveguide corresponds here to the second longitudinal section of the coupling element. In particular, the depth of the iris may be of significance, as it may depend on the depth of the iris whether the iris acts evanescently (damping), or allows the propagation of an electromagnetic wave.

Optional variable shorts, which can be realized by means of shorting plates, can be introduced on the connecting waveguide between the extracted poles. The connecting waveguide can be made, for example, from half-shells which are screwed together or from aluminum sections. Optionally, the waveguide can be outfitted on one or both sides with a replaceable shorting plate to increase the adjustment range. Further adjusting elements in the form of adjusting screws can additionally be placed in the connecting waveguide.

The pole resonators may either be disposed at the filter input or at any desired location in the filter. The filter order can be easily expanded by adding more resonators at the input or output. The addition of further pole resonators is also possible.

For a reduction of the temperature dependence, the filter can either be made from temperature-stable materials, such as Invar, or from temperature-instable materials, such as aluminum, wherein it is outfitted with a temperature compensation unit.

The properties of the channel filter can be described as follows.

The channel filter enables use at differing operating frequencies, which can deviate strongly from one another, at constant mechanical dimensions such as length and width. This is a generic channel filter, so that a new development for different operating frequencies and areas of application can be avoided. During development, it may be necessary only to supply the adjustment data. Identical parts sets for the generic channel filter can be obtained in large quantities, since an individual design of the components depending on the operating frequency is not required. A significant reduction in the development time can take place through a reduction of development effort and elimination of project-related design and manufacturing time. Cost savings can be enabled through mass production, elimination of design costs and partial elimination of development costs. The channel filter enables an individual adjustment with a large adjustment range, so that an achievable production accuracy of generic parts is sufficient and the individual parts need not be made in view of the future operating frequency. By producing large numbers of like parts, the possibility arises for automation of the adjustment. A high degree of planning security can result from standard processes and parts. With respect to consideration of thermal and mechanical parameters during the development of a channel filter, generic analysis with worst-case values is possible. Irrespective of the target frequency and the bandwidth of a channel filter, identical components may be used due to the different adjusting possibilities.

The center frequency of the filter is substantially determined by the resonant frequency of the filter resonators. As described above, a second adjusting element in the form of an adjusting plate can be used for coarse adjustment of the resonant frequency. Such an adjusting plate enables setting of the frequency in very broad ranges. A third adjusting element in the form of a screw which has a smaller cross section or diameter than the adjusting plate and may be disposed in the axis of the plate, further enables the fine adjustment of the filter. The third adjusting element may comprise metallic or dielectric material.

BRIEF DESCRIPTION OF THE DRAWINGS

Hereinafter will be more nearly discussed with reference to the accompanying drawings exemplary embodiments of the invention. The representations are schematic and not to scale. Like reference characters refer to identical or similar elements.

DETAILED DESCRIPTION OF EXEMPLARY EMBODIMENTS

Figure 1:
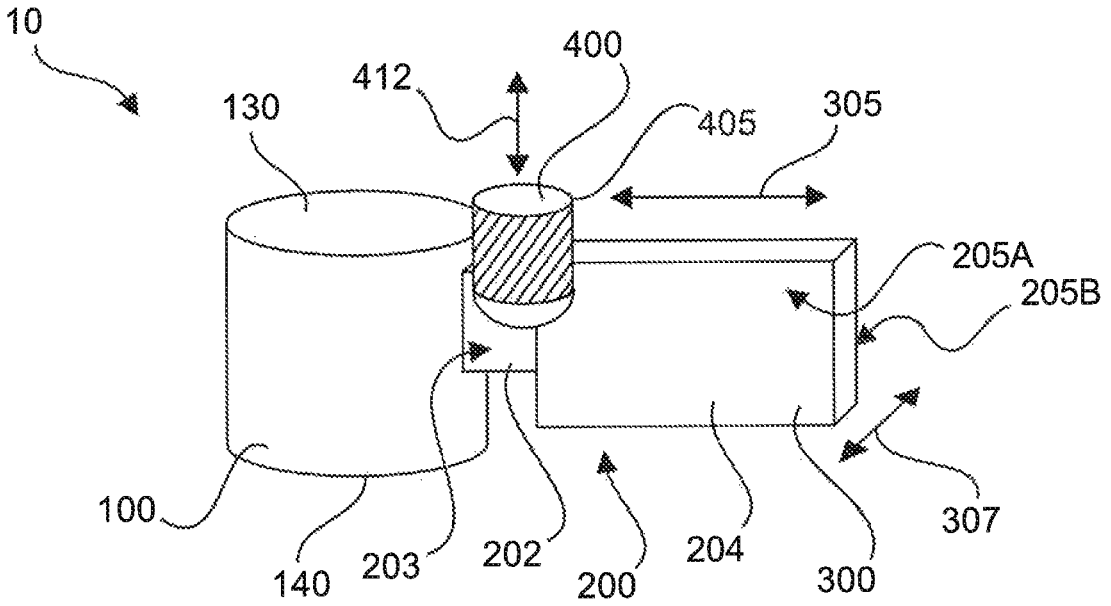
FIG. 1 shows a schematic representation of a channel filter according to one embodiment of the invention.

FIG. 1 shows a part of a channel filter 10 having a resonator 100 and a coupling element 200 coupled thereto.

The resonator is designed as a cylindrical cavity with two opposing base or end surfaces 130, 140. The coupling element 200 is coupled to a circumferential surface of the cylindrical cavity.

The coupling element 200 has a first longitudinal section 202 and a second longitudinal section 204. A first adjusting element 400 is disposed such that it extends in a direction transverse to the longitudinal direction 305 of the coupling element 200 in both the first longitudinal section 202 and the second longitudinal section 204, and that it enables an adjusting movement in the direction of the arrow 412.

The first longitudinal section has a side surface 203. The cross section or the base surface 405 of the adjusting screw 400 is designed such or the adjusting screw 400 disposed such that the adjusting screw protrudes over the side surface 203 (out of the drawing plane toward the viewer, in the direction of arrow 307, which indicates the width of the first coupling element). In one embodiment, the adjusting screw may also protrude over the side surface of the first longitudinal section 202 in the rear in FIG. 1.

The second longitudinal section 204 is wider in direction 307 than the first longitudinal section 202. The adjusting screw 400 is designed and disposed such that it is located in the region of the second longitudinal section 204 between the side surfaces 205A, 205B.

The dimensions of the channel filter are frequency dependent. For a channel filter in the Ku band, the first longitudinal section 202 may have a width of a few cm, for example between 3 and 5 cm, and the second longitudinal section 204 can have a width of over 5 cm, for example between 5 and 12 cm, in particular approximately 9.5 cm. The diameter of the adjusting screw 400 may be greater in one embodiment than the width of the first longitudinal section 202 and smaller than the width of the second longitudinal section 204.

Figure 2:
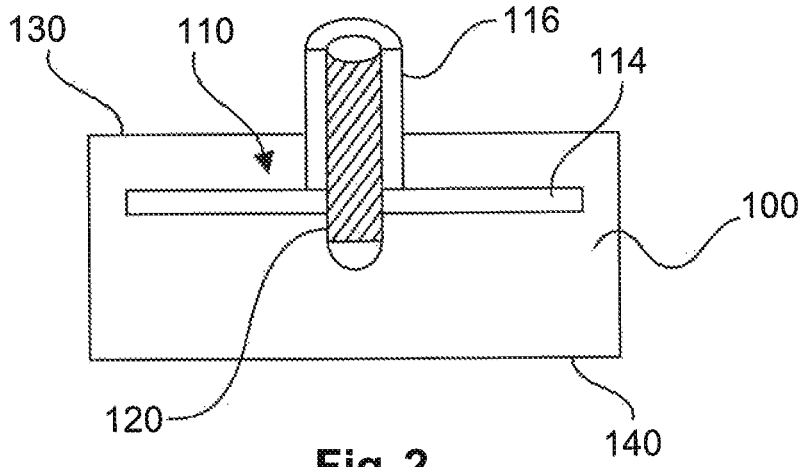
FIG. 2 shows a schematic representation of a resonator of a channel filter according to a further embodiment of the invention.

FIG. 2 shows a resonator 100 having a second adjusting element 110 comprising an adjusting plate 114 and a shaft 116 designed with both a third adjusting element 120 and an adjusting screw, which is disposed in the shaft 116 and can be moved relative to the second adjusting element 110 through a rotational movement of the adjusting screw 120. The second adjusting element 110 can also execute the adjusting movement by means of a rotational movement of the shaft 116 with respect to the base surface 130 of the resonator.

Both the second adjusting element and the third adjusting element enable an adjusting movement in a direction along the arrow 112, 122.

The adjusting plate 114 can be designed to execute an adjusting movement of several cm, for example between 1 cm and 4 cm. The adjusting screw 120 can be designed to execute an adjusting movement of a few tenths of a mm up to a few mm, for example between 0.1 mm up to 2 mm. The adjusting screw 120 has a smaller cross section than the adjusting plate 114 and the shaft 116.

Figure 3:
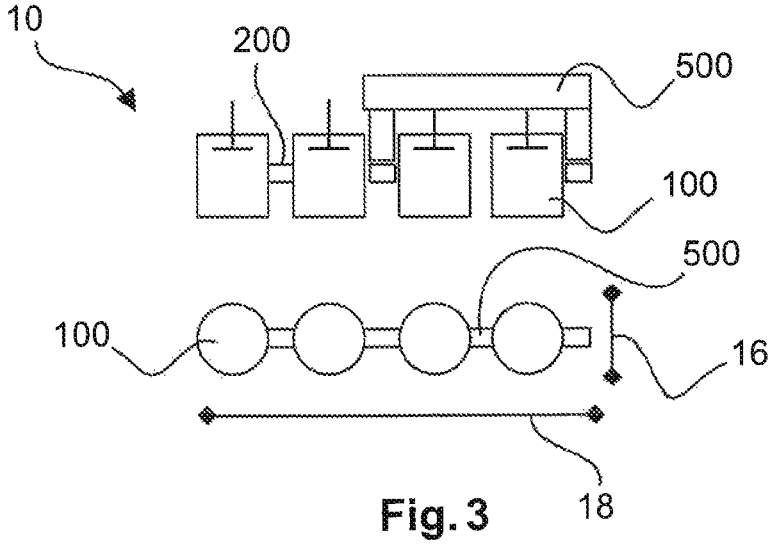
FIG. 3 shows a schematic representation of a channel filter according to a further embodiment of the invention.

FIG. 3 shows a side view (above) and plan view (below) of a channel filter 10 with four resonators 100, wherein directly adjacent resonators are respectively coupled together via a coupling element. The channel filter 10 further comprises a connecting element 500.

The width 16 and length 18 of the channel filter can be held constant or substantially constant independent of the operating frequency, meaning that no adjustments of the geometric dimensions of the channel filter depending on a desired operating frequency are necessary.

Figure 4:
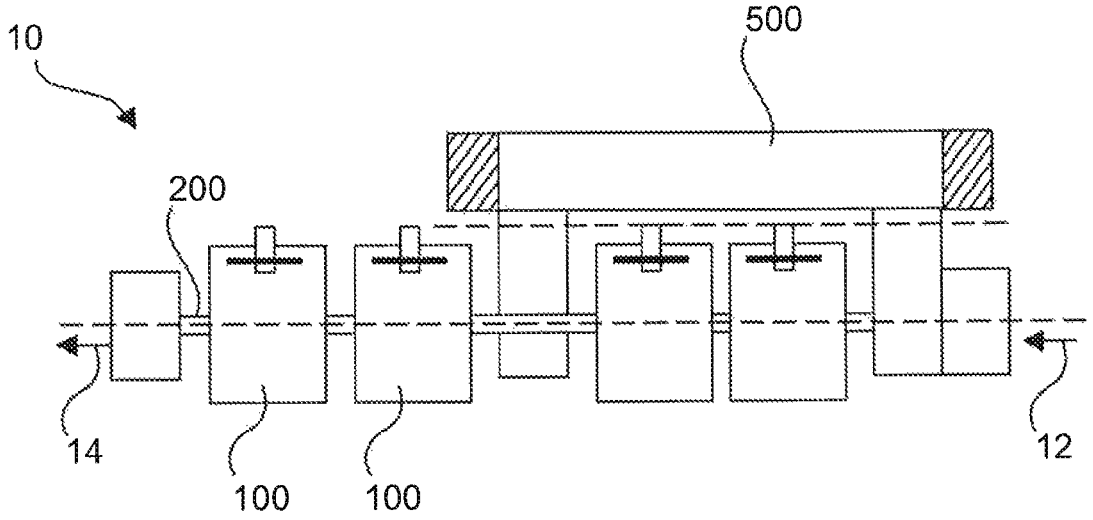
FIG. 4 shows a schematic representation of a channel filter according to a further embodiment of the invention.

FIG. 4 shows a channel filter 10 having a filter input 12 and a filter output 14. The longitudinal direction of the channel filter is indicated by a dotted line. A connecting element 500 connects two resonators.

Figure 5:
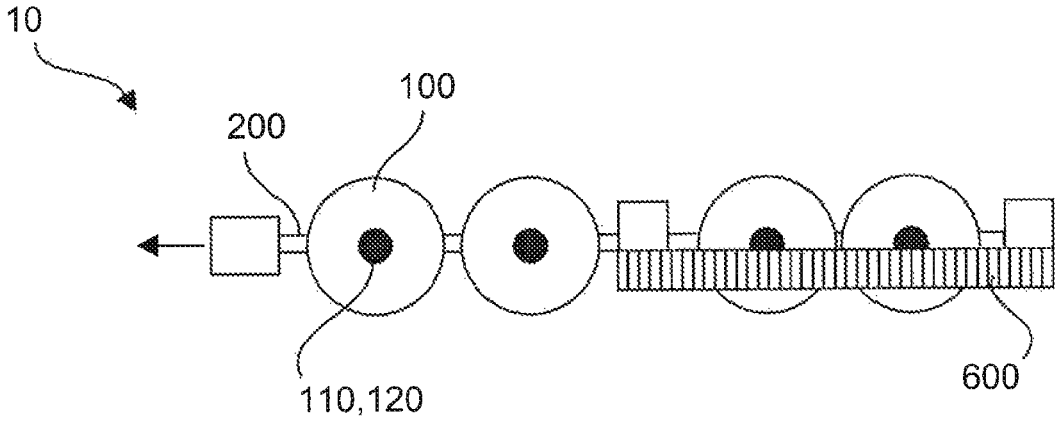
FIG. 5 shows a schematic representation of a channel filter according to a further embodiment of the invention.

FIG. 5 shows a channel filter 10 in a view of the resonator assembly from above. A waveguide 600 is disposed between the poles and can be laterally displaced with respect to a longitudinal axis of the channel filter 10 for better access to the adjusting elements 110, 120. The waveguide can alternatively be disposed centrally.

Figure 6:
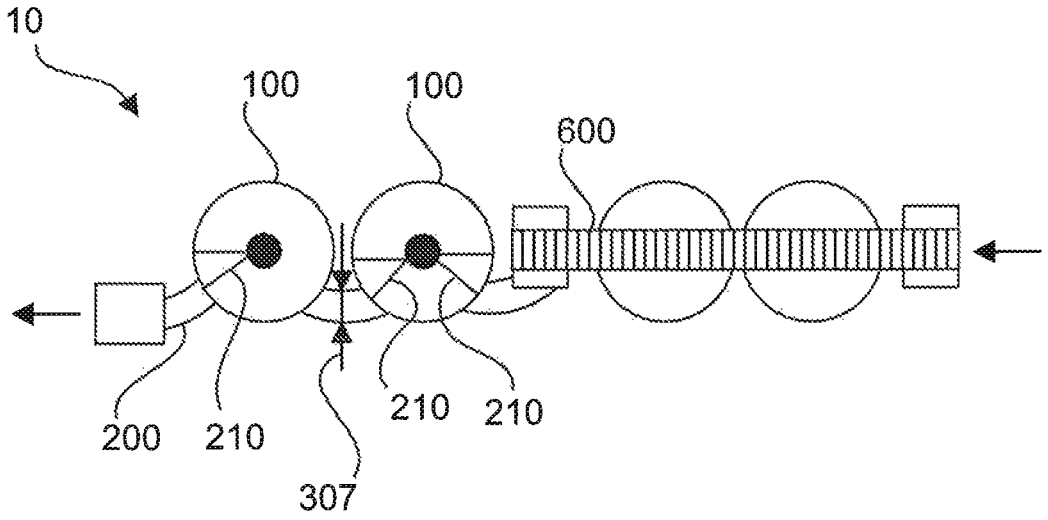
FIG. 6 shows a schematic representation of a channel filter according to a further embodiment of the invention.

FIG. 6 shows a channel filter 10 with coupling elements 200, which are coupled with the resonators 100 at various angles 210 with respect to the longitudinal direction of the channel filter. The connecting waveguide 600 is disposed centrally, and can also be laterally displaced for better accessibility of the adjusting elements, as has been shown in FIG. 5.

Figure 7:
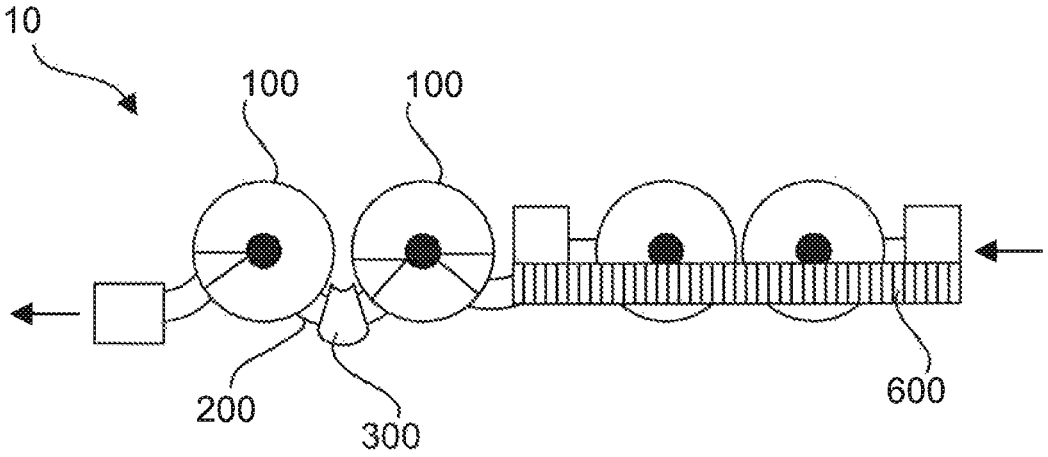
FIG. 7 shows a schematic representation of a channel filter according to a further embodiment of the invention.

FIG. 7 shows a channel filter 10 with coupling coupling elements 200, which are coupled with the resonators 100 at various angles 210 with respect to the longitudinal direction of the channel filter and a laterally displaced connecting waveguide 600. The coupling at different angles is executed as a waveguide structure with enlarged cross section 300 in the central region, in order to achieve a desired coupling value. Sections 200 and 300 represent the first longitudinal section and the second longitudinal section of the coupling element between two resonators.

Figure 8:
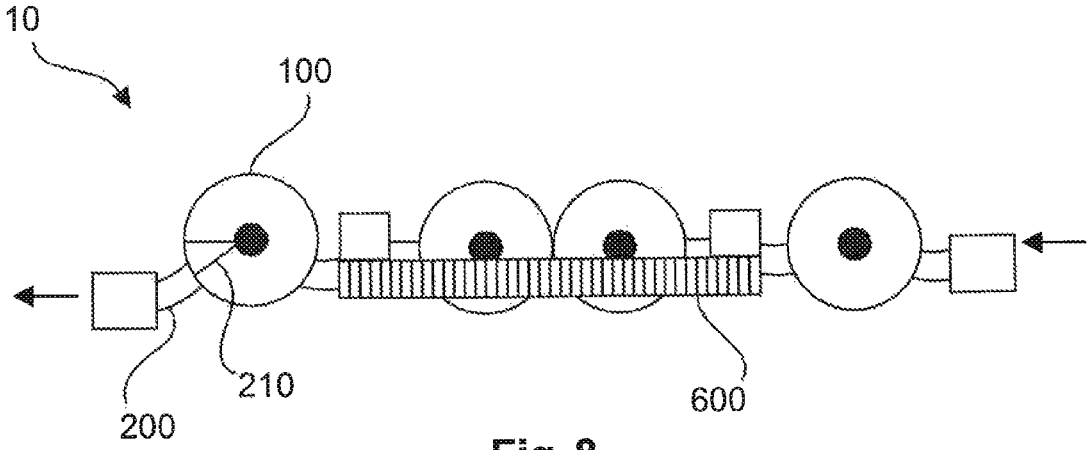
FIG. 8 shows a schematic representation of a channel filter according to a further embodiment of the invention.

FIG. 8 shows a channel filter 10, wherein the connecting waveguide 600 is displaced in the longitudinal direction with respect to the embodiment in FIG. 7, meaning that it bridges other resonators.

Figure 9:
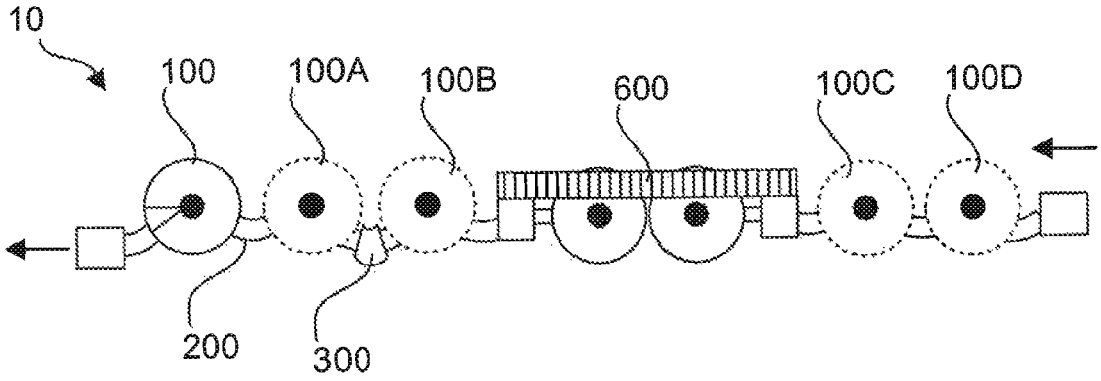
FIG. 9 shows a schematic representation of a channel filter according to a further embodiment of the invention.

FIG. 9 shows a channel filter 10 and indicates expansion possibilities for a higher-circuit filter (any number of resonators may be added, these are shown as dotted lines).

| List of reference characters | |
|---|---|
| 10 | channel filter |
| 12 | input |
| 14 | output |
| 16 | width |
| 18 | length |
| 100 | resonator |
| 110 | second adjusting element |
| 112 | adjusting movement |
| 114 | plate |
| 116 | shaft |
| 120 | third adjusting element |
| 122 | adjusting movement |
| 130 | first surface |
| 140 | second surface |
| 200 | coupling iris |
| 202 | first longitudinal section |
| 203, 205 | side surface |
| 204 | second longitudinal section |
| 210 | coupling angle |
| 300 | waveguide |
| 305 | longitudinal direction |
| 307 | width |
| 400 | first adjusting element |

-continued

| List of reference characters | |
|---|---|
| 405 | base surface |
| 412 | adjusting movement |
| 500 | connecting element |
| 600 | shorting element |

What is claimed is:

1. A channel filter for a communication apparatus, comprising:

a first resonator;

a coupling element having a first longitudinal section and a second longitudinal section; and a first adjusting element, wherein the coupling element is designed to couple the first resonator indirectly with at least an input or output of the channel filter, wherein the first longitudinal section has a smaller width than the second longitudinal section, wherein the first adjusting element is disposed at least partially in the first longitudinal section and at least partially in the second longitudinal section, and wherein the second longitudinal section is a waveguide.

2. The channel filter according to claim 1, wherein the first longitudinal section is a coupling iris.

3. The channel filter according to claim 2, wherein the first adjusting element protrudes in a direction transverse to a longitudinal direction of the coupling element over a side surface of the first longitudinal section.

4. The channel filter according to claim 2, wherein the first adjusting element is disposed in first longitudinal section, such that the first adjusting element extends in a longitudinal direction into the second longitudinal section, between two opposite side surfaces of the second longitudinal section.

5. The channel filter according to claim 1, wherein the first adjusting element protrudes in a direction transverse to a longitudinal direction of the coupling element over a side surface of the first longitudinal section.

6. The channel filter according to claim 1, wherein a coupling angle of the coupling element with the first resonator has a deviation of 0° with respect to a first longitudinal direction of the channel filter.

7. The channel filter according to claim 1, wherein the first adjusting element is disposed in the first longitudinal section, such that the first adjusting element extends in a longitudinal direction into the second longitudinal section, between two opposite side surfaces of the second longitudinal section.

8. The channel filter according to claim 1, having a second resonator, which is coupled with the first resonator via the coupling element.

9. The channel filter according to claim 8, further comprising a shorting element, which is disposed to bridge at least the second resonator to the first resonator.

10. The channel filter according to claim 8, wherein the first resonator has a second adjusting element, which is configured for a coarse adjustment of a resonant frequency of the first resonator.

11. The channel filter according to claim 10, wherein the first resonator has a third adjusting element, which is configured for a fine adjustment of the resonant frequency of the first resonator.

12. The channel filter according to claim 11, wherein the third adjusting element is mechanically coupled with the second adjusting element.

13. The channel filter according to claim 1, wherein the first resonator has a second adjusting element, which is configured for a coarse adjustment of a resonant frequency of the first resonator.

14. The channel filter according to claim 13, wherein the first resonator has a third adjusting element, which is configured for a fine adjustment of the resonant frequency of the first resonator.

15. The channel filter according to claim 14, wherein the third adjusting element is mechanically coupled with the second adjusting element.

16. The channel filter according to claim 15, wherein the third adjusting element is movable with respect to the second adjusting element.

17. The channel filter according to claim 14, wherein the third adjusting element is movable with respect to the second adjusting element.

* * * * *